US005358037A

United States Patent [19]

Edwards et al.

[11] Patent Number: 5,358,037

[45] Date of Patent: Oct. 25, 1994

[54] FLOAT OPERATED PNEUMATIC PUMP

[75] Inventors: David H. Edwards, Ann Arbor; Kevin L. Newcomer, Monroe; K. Lynn Niehaus, Manchester, all of Mich.

[73] Assignee: QED Environmental Systems, Inc., Ann Arbor, Mich.

[21] Appl. No.: 38,835

[22] Filed: Mar. 29, 1993

[51] Int. Cl.[5] ..... E21B 43/00

[52] U.S. Cl. ..... 166/105; 166/107; 417/131

[58] Field of Search ..... 166/105, 107; 417/86, 417/90, 116, 126, 131, 138

[56] References Cited

U.S. PATENT DOCUMENTS

| | | | |
|---|---|---|---|
| 1,439,591 | 12/1922 | Welden | 417/131 |
| 2,141,261 | 12/1938 | Clark . | |
| 2,606,500 | 8/1952 | Schmidt . | |
| 3,007,416 | 11/1961 | Childs . | |
| 3,039,309 | 6/1962 | Vesper et al. . | |
| 3,048,121 | 8/1962 | Sheesley . | |
| 3,074,351 | 1/1963 | Foster . | |
| 3,148,624 | 9/1964 | Baldwin . | |
| 3,154,021 | 10/1964 | Vick, Jr. . | |
| 3,173,372 | 3/1965 | Baldwin . | |
| 3,175,498 | 3/1965 | Rohrer . | |
| 3,194,170 | 7/1965 | Ulbing . | |
| 3,298,320 | 1/1967 | Latham, Jr. . | |
| 3,647,319 | 3/1972 | McLean et al. . | |
| 3,677,667 | 7/1972 | Morrison . | |
| 3,724,973 | 4/1973 | Shill . | |
| 3,816,032 | 6/1974 | Flynn et al. . | |
| 3,949,753 | 4/1976 | Dockhorn . | |
| 3,983,857 | 10/1976 | O'Connor . | |
| 3,987,775 | 10/1976 | O'Connor . | |
| 4,020,978 | 5/1977 | Szczepanski . | |
| 4,030,640 | 6/1977 | Citrin et al. . | |
| 4,104,005 | 8/1978 | Poirier . | |
| 4,184,811 | 1/1980 | Schade . | |
| 4,257,751 | 3/1981 | Kofahl . | |
| 4,295,801 | 10/1981 | Bennett . | |
| 4,438,654 | 3/1984 | Tortensson . | |
| 4,489,779 | 12/1984 | Dickinson et al. . | |
| 4,580,952 | 4/1986 | Eberle . | |
| 4,585,060 | 4/1986 | Bernardin et al. . | |

(List continued on next page.)

*Primary Examiner*—Ramon S. Britts
*Assistant Examiner*—Frank S. Tsay
*Attorney, Agent, or Firm*—Harness, Dickey & Pierce

[57] ABSTRACT

A float operated pneumatic pump has an outer pump body forming an outer chamber and a dip tube forming an inner chamber therein. The inner chamber of the dip tube is in communication with the outer chamber of the pump body through a back flow discharge check valve. An inlet is located at a first end of the outer pump body for permitting liquids to enter both the inner and outer chambers. A discharge housing is located at a second end of the tubes and contains a liquid discharge port in communication with the second end of the dip tube. An air inlet port is located in the discharge housing for permitting pressurized air to enter the second end of the outer pump body. An air exhaust port is provided for permitting air in the outlet chamber to escape to atmosphere when fluid is entering the inner and outer chambers. A float is disposed on the outside of the dip tube within the outer chamber of the pump body. The float provides buoyancy to actuate the pump and provides weight to de-activate the pump. An inlet valve is disposed within the air inlet port for selectively admitting in a discharge mode, and blocking in a refill mode the source of compressed air into the outer chamber of the pump body. An exhaust valve is disposed within the air exhaust port for selectively venting in the refill mode and blocking in the discharge mode the outer chamber to the air discharge port. An actuator linkage, or a lost motion device, is coupled between the float and an off center pivot lever. The off center pivot lever actuates both the inlet and exhaust valves with the off center feature of the pivot lever increasing the force of the buoyant float. The float operated fluid pump further includes first and second attracting magnets, the first magnet being located on the movable end of the off center pivot lever and the second magnet being located within the discharge housing. The first and second magnets come together by movement of the float and operate to keep the pumping system in the discharge mode until the weight of the float separates the magnets and moves the pumping system into the refill mode.

10 Claims, 4 Drawing Sheets

U.S. PATENT DOCUMENTS 4,603,735 8/1986 Black ..... 166/105 X
4,669,554 6/1987 Cordy .
4,701,107 10/1987 Dickinson et al. .
4,727,936 3/1988 Mioduszewski et al. .
4,807,707 2/1989 Handley et al. .
4,886,432 12/1989 Kimberlin .
4,974,674 12/1990 Wells ..... 166/107
4,998,585 3/1991 Newcomer et al. .
5,004,405 4/1991 Breslin .
5,033,550 7/1991 Johnson et al. ..... 166/105 X
5,141,404 8/1992 Newcomer et al. .
5,147,184 9/1992 Newcomer et al. ..... 166/105 X
5,147,185 9/1992 Niehaus et al. .
5,161,956 11/1992 Fiedler ..... 417/86

FLOAT OPERATED PNEUMATIC PUMP

FIELD OF THE INVENTION

The present invention relates generally to underground fluid pumping systems. More particularly, the present invention relates to underground fluid pumping systems which are capable of activating in response to the surrounding liquid levels.

BACKGROUND OF THE INVENTION

Increased monitoring of environmental quality has resulted in a substantial rise in the number of identified sites of contaminated ground water. Accompanying this trend has been an increased effort to clean up these sites. In response, there is a need for improved below ground pumping systems to assist in these clean up efforts.

Ideally, below ground pumping systems used for these purposes will have a number of desired characteristics. Because of the large number of pumping systems required, it is desirable to minimize the cost of each pump and each installation. Accordingly, such pumps should be relatively simple and inexpensive and should fit in a small diameter well due to the increased cost of drilling large diameter wells. To minimize maintenance and repair costs, the pumps should have a minimum of moving parts and should have high reliability. Also, such pumps should be able to withstand corrosive fluid streams without failure.

Due to the possibility of exposure of the pumping systems to explosive gasses, pneumatic pumps are preferred over electrical pumps for pumping waste products. However, many of the currently used pneumatic pumps have a number of drawbacks. For example, many pumps in current use require external controlling devices which use timers to activate the pump on a fixed schedule. This necessity of external controllers adds considerably to the cost and complexity of the overall pumping system. In addition, the use of a fixed time pumping schedule has disadvantages since it may not result in pumping at the most opportune time to obtain the maximum production from the pump. For example, an external timer cannot sense variations in the flow rate of fluid into the pump and thus may result in either a too fast or a too slow pumping cycle.

There are pumps which avoid the necessity of external controllers by incorporating sensing means within the pump to detect when fluid has entered the pump to a desired level. Unfortunately, the prior art pumps which are capable of self activation have not proved satisfactory in many applications. One problem has been with the mechanical actuating and sensing mechanism within the pumps. Generally, such pumps use a float which rises when the pumps fills and lowers when the pump is empty. Actuating mechanisms which sense the movement of this float sometimes require considerable force to switch the pumps pneumatic vane on and off. This results in the necessity of a fairly large and heavy float which increases the overall size and cost of the pump system.

In addition to the problems with the actuating mechanism, the pneumatic valve used to control the flow of compressed air into these pumps have often proved unreliable. Spool type valves incorporating sliding seals are generally used in prior art pumps of this nature. The force necessary to move these sliding seals to actuate spool type valves are one source of the excess actuating force requiring the above mentioned large and heavy floats. In addition, spool type valves result in high maintenance and repair costs due to their tendency to freeze or to leak. There are a number of causes of the difficulties with sliding seals. These include debris entering the seals from the source of compressed air; contamination of the seals from the liquid being pumped (especially where highly corrosive waste products are pumped); loss of lubrication in the seals; and compression set of the elastomeric seals if they remain inactive for an extended period of time. In addition, some prior art pumps employ valves which have a significant cross over point where air supply is partially open and air exhaust is partially closed. At this point, the pump will tend to use a large amount of compressed air in an effort to switch to a fully open or a fully closed position. In some cases, the pump may reach a steady state condition with the head pressure in the surrounding well causing the pump to remain in a cross over, or all ports open, position.

Another difficulty with sliding seals results from their use to provide a detent action between the discharge and refill cycles of the valve. As the sliding seals wear, the ability of these sliding seals to provide a detent action will be lost. The sliding seals are normally comprised of O-rings and the wear of these O-rings will result in short and erratic pump cycles unless the O-rings are replaced. Thus, it would be desirable to provide an underground pumping system which overcomes some or all of the above mentioned difficulties.

Accordingly, it is an object of the present invention to provide a simple and inexpensive pumping system for installing in small diameter wells. It is a further object of the present invention to provide such a pumping system which is reliable, has a limited number of moving parts and which provides automatic on/off level control to eliminate the need for external controllers.

It is an additional object of the present invention to provide an underground pumping system which uses a pneumatic valve that avoids the use of sliding seals and which is switched between pumping and discharge cycles with a minimum of actuation force and without experiencing cross over. It is a further object for the present invention to provide such a pumping system having a reliable and durable detent between pump discharge and refill cycles.

SUMMARY OF THE INVENTION

The present invention provides a pumping system for pumping liquid out of a well. The pumping system comprises an outer pump body forming an outer chamber and a dip tube forming an inner chamber therein. The inner chamber of the dip tube is in communication with the outer chamber of the pump body through a back flow discharge check valve. An inlet means is located at a first end of the outer pump body for permitting liquids to enter both the inner and outer chambers. A discharge housing is located at a second end of the tubes and contains a liquid discharge port in communication with the second end of the dip tube. An air inlet port is located in the discharge housing for permitting pressurized air to enter the second end of the outer pump body. An air exhaust port is provided for permitting air in the outlet chamber to escape to atmosphere when fluid is entering the inner and outer chambers. A float is disposed on the outside of the dip tube within the outer chamber of the pump body. The float provides buoyancy to actuate the pump and provides weight to de-activate the pump. An inlet valve is disposed within the air inlet port for selectively admitting in a discharge mode, and blocking in a refill mode the source of compressed air into the outer chamber of the pump body. An exhaust valve is disposed within the air exhaust port for selectively venting in the refill mode and blocking in the discharge mode the outer chamber to the air discharge port. An actuator linkage, or a lost motion device, is coupled between the float and an off center pivot lever. The off center pivot lever actuates both the inlet and exhaust valves with the off center feature of the pivot lever increasing the force of the buoyant float.

In accordance with the preferred embodiment of the present invention, the pumping system includes first and second attracting magnets, the first magnet being located on the movable end of the off center pivot lever and the second magnet being located within the discharge housing. The first and second magnets come together by movement of the float and operate to keep the pumping system in the discharge mode until the weight of the float separates the magnets and moves the pumping system into the refill mode.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
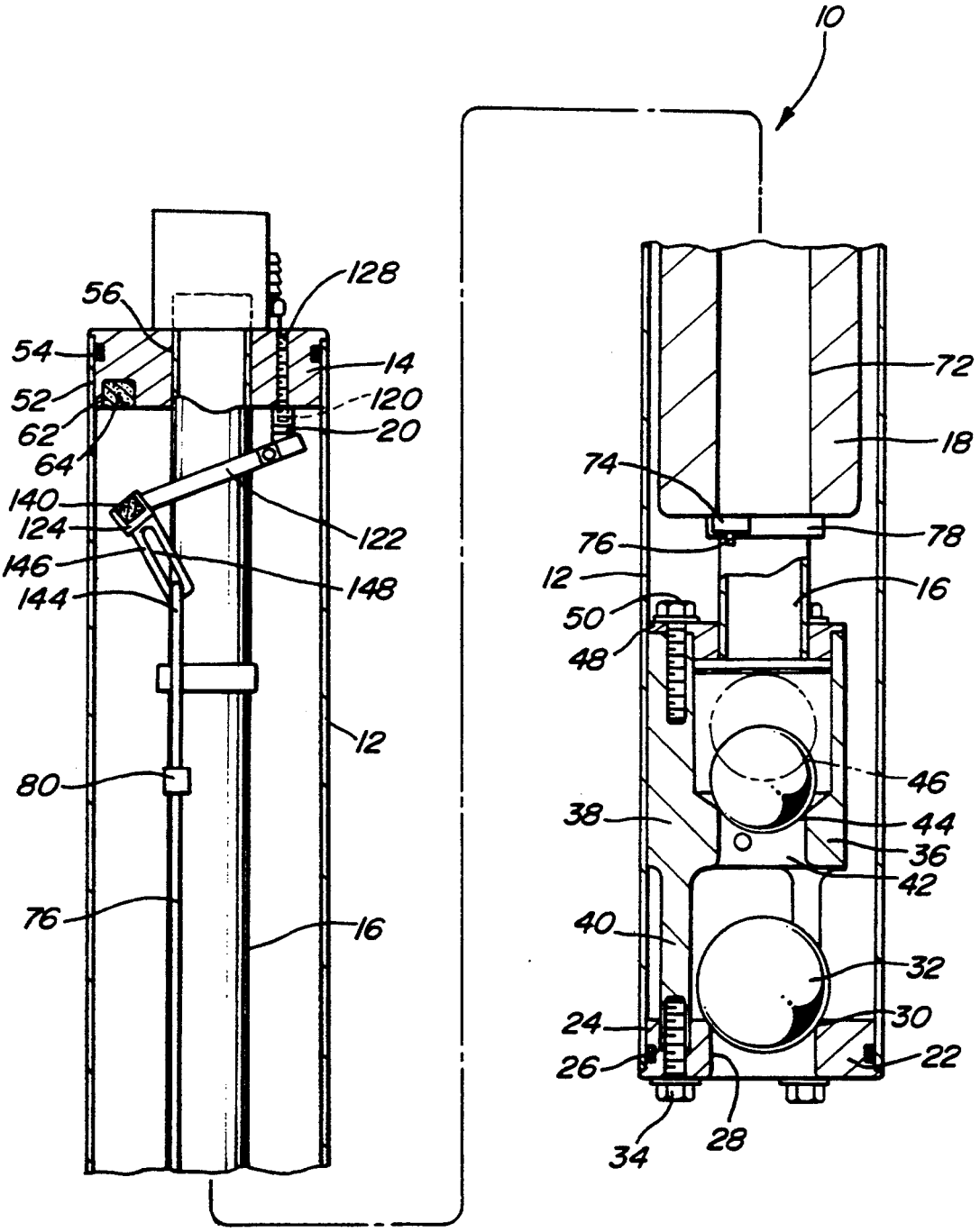
FIG. 1 is a longitudinal cross-sectional view of the pumping system in accordance with the present invention shown in the refill cycle.

Referring now to the drawings in which like reference numerals designate like or corresponding parts throughout the several views, there is shown in FIGS. 1 through 5 a pumping system 10 in accordance with the present invention. Pumping system 10 comprises a hollow pump body 12, a discharge housing 14, a dip tube 16, a float 18 and an activation mechanism 20.

Pump body 12 is a cylindrical hollow tube preferably composed of a rigid material not susceptible to corrosion, such as stainless steel. Pump body 12 is closed at its lower end by an end cap check valve 22 which is inserted into the lower end of pump body 12. End cap check valve 22 has a reduced diameter section 24 for insertion into pump body 12 and includes a seal 26 to form a liquid tight seal between end cap check valve 22 and pump body 12. End cap check valve 22 includes an inlet port 28 which extends through end cap check valve 22 and defines a valve seat 30 which mates with a check ball 32 to form a check valve which will allow fluid flow from the area around pump system 10 (the interior of the well within which pump system 10 is inserted) to the interior of pump body 12 but fluid flow in the opposite direction is prohibited.

Secured to the top of end cap check valve 22 by a plurality of bolts 34 is a backflow discharge check valve 36. Backflow discharge check valve 36 includes a housing 38 having a plurality of legs 40 extending from it. The plurality of legs 40 space housing 38 away from end cap check valve 22 and provide the necessary room for check ball 32 to operate. The plurality of legs 40 also operate to form a cage which encapsulates check ball 32 while still permitting fluid flow through inlet port 28 into pump body 12. Housing 38 defines an outlet port 42 which extends through housing 38 and defines a valve seat 44 which mates with a check ball 46 to form check valve 36 which will allow fluid flow from the interior of pump body 12 through dip tube 16 but fluid flow in the opposite direction is prohibited. A cap 48 is secured to the top of housing 38 by a plurality of bolts 50 and operates to retain check ball 46 within housing 38 as well as providing for the attachment of dip tube 16 as will be described later herein.

At the opposite end of pump body 12 is discharge housing 14 which has a reduced diameter portion 52 for inserting it into pump body 12. A seal 54 forms a liquid and air tight seal with pump body 12. Discharge housing 14 includes a liquid discharge port 56 which extends through discharge housing 14 and is adapted for mating with dip tube 16 as will be described later herein. Discharge housing 14 further includes an air inlet port 58, an air discharge port 60 and a bore 62 for locating a first actuating magnet 64. Air inlet port 58 is adapted to receive an air inlet valve 66 and air discharge port 60 is adapted to receive an air discharge valve 68 as will be described later herein.

Dip tube 16 extends from discharge port 56 of discharge housing 14 to cap 48 of housing 38. Dip tube 16 is sealingly secured to both discharge housing 14 and cap 48 by welding or other means known well in the art. Dip tube 16 provides a path for the fluid within pump body 12 to flow out of pump body 12 through dip tube 16 and through discharge port 56. Discharge port 56 is in communication with both dip tube 16 and a discharge tube (not shown) for transporting the pumped fluid to the surface.

Float 18 is disposed within the interior of pump body 12 and defines an axial bore 72 into which dip tube 16 is inserted. There is sufficient clearance between axial bore 72 and the exterior of dip tube 16 to permit float 18 to freely move up and down along dip tube 16. Float 18 further defines a second axial bore (not shown) into which an actuating rod 76 is inserted. Actuating rod 76 is positioned , parallel to dip tube 16 and there is sufficient clearance between the second axial bore in the float 18 and the exterior of actuating rod 76 to permit float 18 to freely move up and down along actuating rod 76, A lower stop 78 is fixedly secured to dip tube 16 and is positioned towards the lower end of actuating rod 76 to limit the downward movement of float 18. A second lower stop 74 is fixedly secured to actuating rod 76 and is positioned towards the lower end of actuating rod 76 in order for the weight of float 18 to be able to deactivate the pumping of pump system 10. An upper stop 80 is fixedly secured to actuating rod 76 and is positioned towards the upper end of actuating rod 76 to limit the upward movement of float 18. Float 18 is less dense than the liquid to be pumped and thus provides sufficient lifting action when pump body 12 is filled with fluid to activate pump system 10 as will be explained later herein. Float 18 also provides sufficient weight to de-activate the pumping of pump system 10 as will also be explained later herein.

Air inlet valve 66 has a generally cylindrical shaped housing 82 defining an external surface 84 and an internal surface 86. External surface 84 is adapted to mate with air inlet port 58 within discharge housing 14. An annular groove 88 is defined by external surface 84 and receives a seal 90 for sealing the connection between discharge housing 14 and air inlet valve 66. Once adjusted to the proper location, air inlet valve 66 is fixedly secured in position by a set screw 92. Internal surface 86 defines a threaded end 94 for connection to a tube (not shown) which supplies the compressed air to pump system 10 for activation. The end of internal surface 86 opposite to threaded end 94 forms an inlet valve seat 96. A ball 98 is positioned between threaded end 94 and valve seat 96. Ball 98 cooperates with valve seat 96 to connect and disconnect the compressed air being supplied to air inlet valve 66 with the interior of pump body 12. A retaining ring 100 is provided to maintain ball 98 within air inlet valve 66. While air inlet valve 66 has been shown and described as being a separate component secured within inlet port 58, it is within the scope of the present invention to have inlet valve 66 machined as an integral part of discharge housing 14.

Air discharge valve 68 has a generally cylindrical shaped housing 102 defining an external surface 104 and an internal surface 106. External surface 104 is adapted to mate with air discharge port 60 within discharge housing 14. An annular groove 108 is defined by external surface 104 and receives a seal 110 for sealing the connection between discharge housing 14 and air discharge valve 68. Once adjusted to the proper position, air discharge vane 68 is fixedly secured in position by set screw 112. Internal surface 106 defines a threaded end 114 for connection to a tube (not shown) which vents the interior of pump body 12 to the atmosphere. The end of internal surface 104 opposite to threaded end 114 forms an outlet valve seat 116. Outlet valve seat 116 is faced away from threaded end 114 and is adapted to mate with a spring loaded check ball 118 which is secured to activation mechanism 20. Check ball 118 cooperates with valve seat 116 to connect and disconnect the interior of pump body 12 with the outside atmosphere. While air discharge valve 68 has been shown and described as being a separate component secured within air discharge port 60, it is within the scope of the present invention to have air discharge valve 68 machined as an integral part of discharge housing 14.

Figure 2:
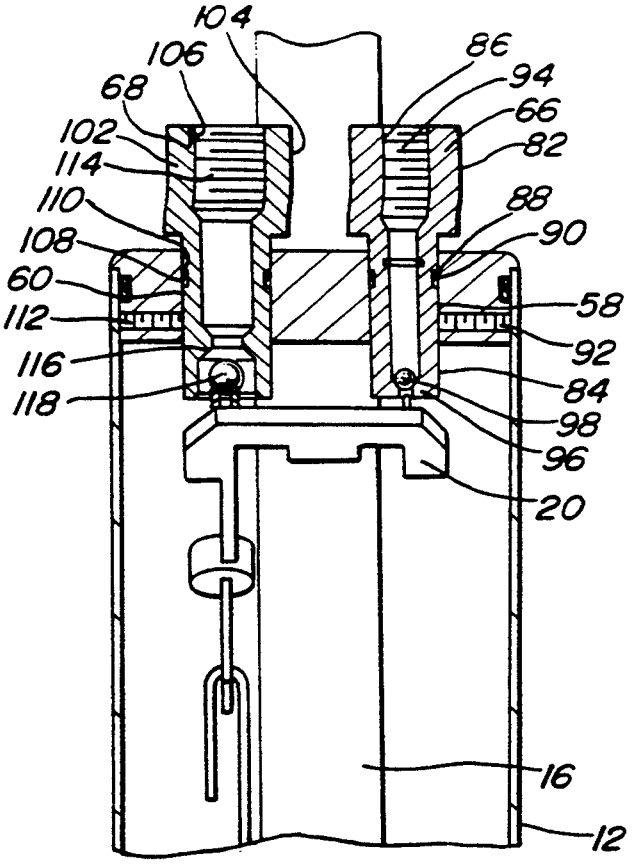
FIG. 2 is an enlarged cross-sectional view of the inlet and exhaust valves of the pumping system shown in FIG. 1 in the refill mode.
Figure 4:
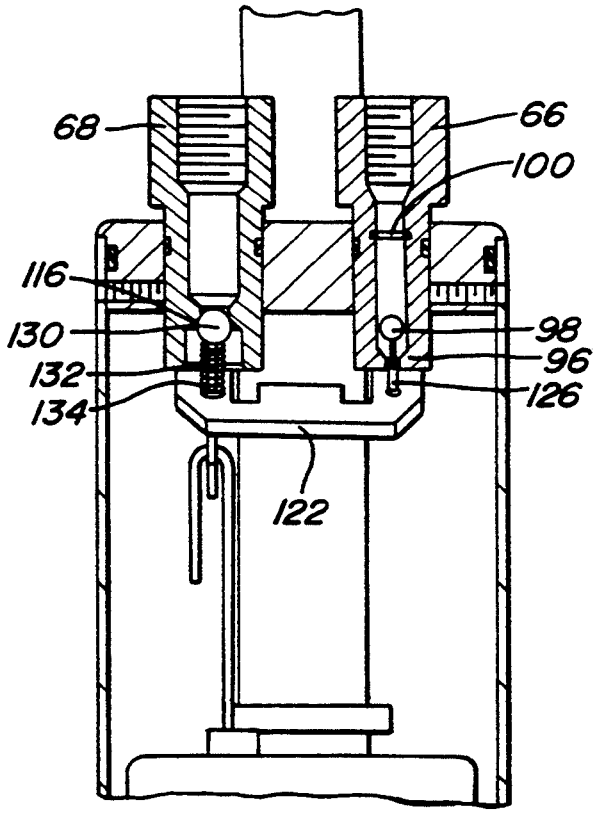
FIG. 4 is an enlarged cross-sectional view of the inlet and exhaust valves of the pumping system shown in FIG. 3 in the discharge mode.
Figure 3:
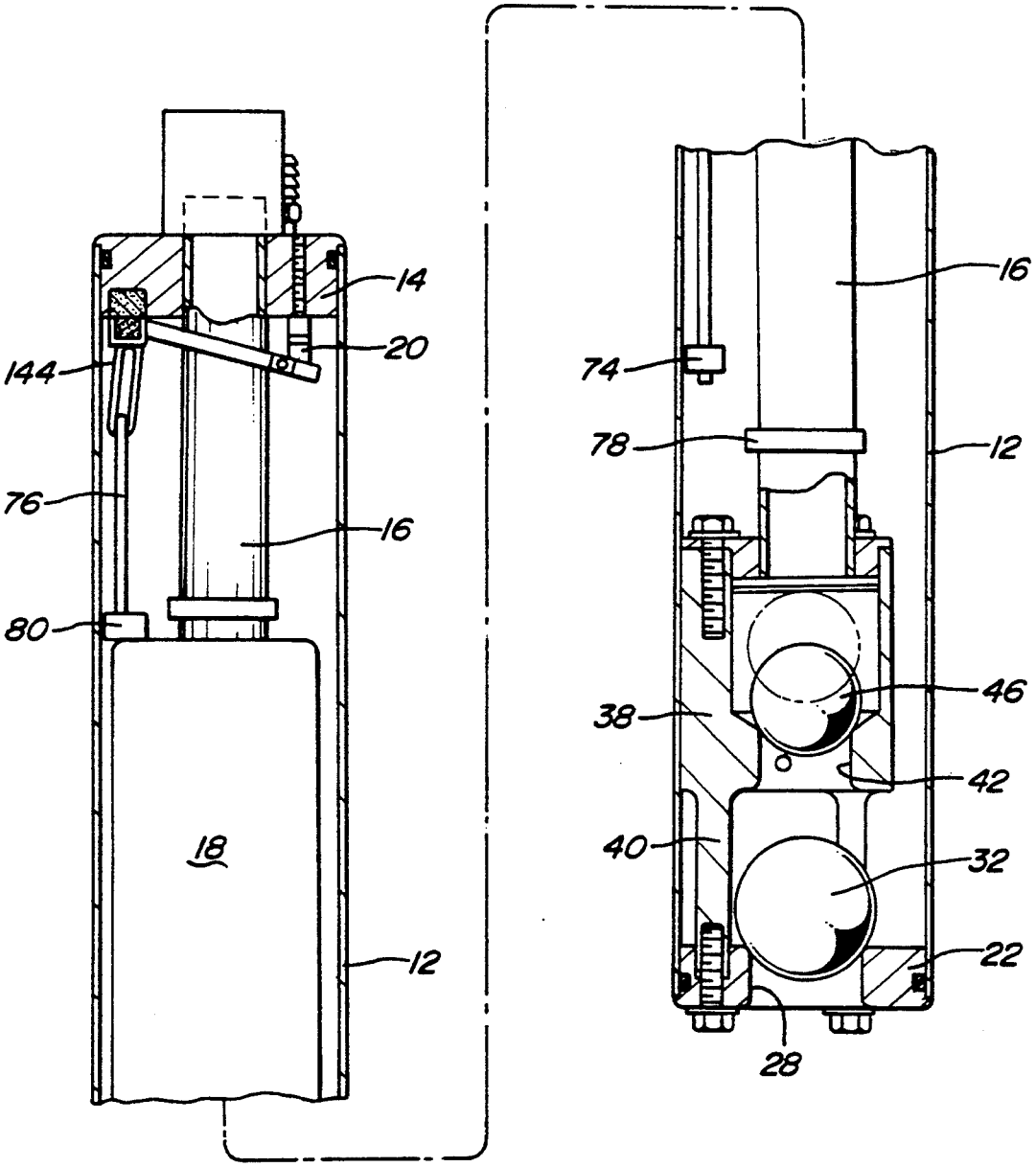
FIG. 3 is a longitudinal cross-sectional view of the pumping system in accordance with the present invention in the discharge cycle.
Figure 5:
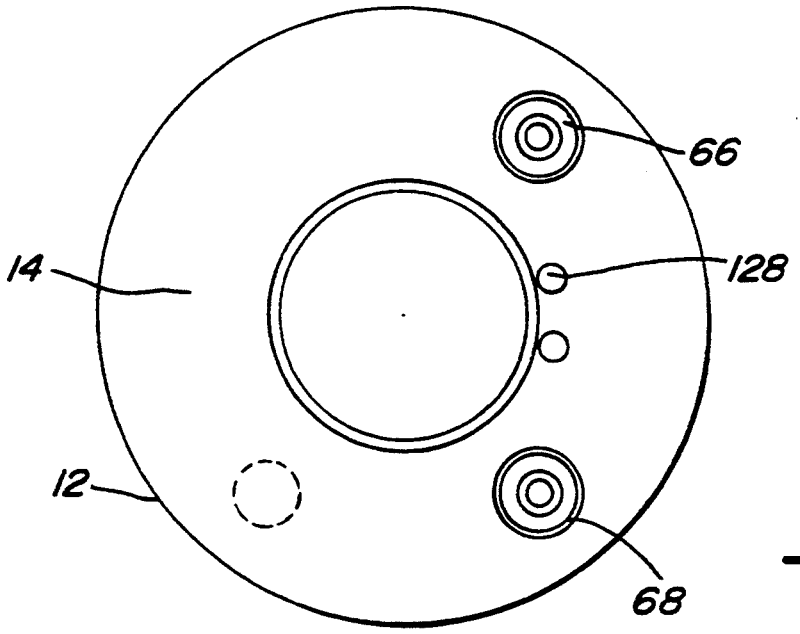
FIG. 5 is a top view of the pumping system shown in FIG. 6 showing the relative location of the connection to the pumping system.

Activation mechanism 20 comprises a bracket 120, an activation arm 122 and a magnet holder 124. Bracket 120 is fixedly secured to discharge housing 14 by a plurality of bolts 128. Pivotally attached to bracket 120 is activation arm 122. Activation arm 122 is a generally U-shaped arm which partially encircles dip tube 16. Activation arm 122 is adapted along the length of the two leg sections for mounting check ball 118 of air discharge valve 68, for mounting an activation pin 126 for activating air inlet valve 66 and for locating magnet holder 124. Activation pin 126 is mounted to one leg of activation arm 122. Activation pin 126 is mounted to one leg of activation arm 122 such that activation pin 126 contacts ball 98 and lifts ball 98 off of inlet valve seat 96 opening air inlet valve 66 when activation arm 122 is pivoted upward as shown in FIG. 4. When activation arm 122 is pivoted downward as shown in FIG. 2, ball 98 is again free to locate in inlet valve seat 96 thus closing air inlet valve 66. Check ball 118 comprises a spherical head 130 and a cylindrical stem 132. Cylindrical stem 132 is inserted through a hole in one of the legs of activation arm 122 opposite to the leg which mounts activation pin 126 and is secured to activation arm 122 by means known well in the art such that spherical head 130 is allowed to move perpendicular with respect to activation arm 122. A coil spring 134 biases spherical head 130 away from activation arm 122. Upon upward movement of activation arm 122 as shown in FIG. 4, spherical head 130 engages outlet valve seat 116 and closes air discharge exhaust valve 68. When activation arm 122 is pivoted downward as shown in FIG. 2; spherical head 130 is disengaged from outlet valve seat 116 and air discharge valve 68 is open. The spring action of check ball 118 permits closing of air discharge valve 68 before the opening of air intake valve 66 thereby eliminating any cross over as well as taking up any wear between spherical head 130 and valve seat 116. During assembly of pump system 10, air intake valve 66 and air discharge valve 68 are inserted into discharge housing 14 and adjusted such that spherical head 130 contacts outlet valve seat 116 at the same time or just prior to activation pin 126 contacting ball 98. This adjustment insures elimination of any cross over. Once adjusted, air intake valve 66 and air discharge valve 68 are secured in place by set screws 92 and 112 respectively.

Magnet holder 124 is attached to the open end of one of the legs of activation arm 122. Magnet holder 124 receives a second actuating magnet 140. The lower end of magnet holder 124, or the end opposite to magnet 140, is attached to an actuator linkage or lost motion device 144. Magnet 140 is adapted to mate with magnet 64 to keep activation arm 122 in an upward position thus maintaining the discharge mode of pump system 10 until the weight of float 18 acts to separate the two magnets and switch pump system 10 into the refill mode. Actuator linkage 144 makes the connection between magnet holder 124 of activation mechanism 20 and float 18. Actuator linkage 144 comprises a bracket 146 which is fixedly attached to the lower end of magnet holder 124 and has a longitudinally extending slot 148. Actuating rod 76 has a U-shaped bend in the upper end thereof such that actuating rod 76 extends through slot 148 of bracket 146. Linkage 144 allows relative movement between actuating rod 76 and activation mechanism 20 to allow for the movement of activation arm 122 due to the mutual attraction of magnets 64 and 140 as will be described later herein.

The operation of pump system 10 begins with the insertion of pump system 10 within a well (not shown). Appropriate connecting tubes (not shown) attach air inlet valve 66 to a source of compressed air, air discharge valve 68 to the outside atmosphere and discharge housing 14 to a discharge fine. Upon insertion into the well, pump system 10 is in the refill mode as shown in FIGS. 1 and 2. Fluid from the well enters the interior of pump body 12 through end cap check valve 22. This refill mode continues due to the hydrostatic effect of the fluid within the well and continues to fill pump body 12 which causes float 18 to begin to rise.

Float 18 continues to rise until contact is made with upper stop 80 on actuating rod 76. This contact with upper stop 80 begins to move actuating rod 76 upward until stop 80 contacts bracket 146. Continued upward movement of float 18 will then begin to pivot actuation arm 122. As activation arm 122 continues to pivot, spherical head 130 of check ball 118 of air discharge exhaust valve 68 will come into contact with outlet valve seat 116 closing air discharge valve 68. At the same time or shortly after spherical head 130 contacts outlet valve seat 116, activation pin 126 of activation mechanism 20 contacts ball 98 lifting ball 98 off of inlet valve seat 96 and providing compressed air into the interior of pump body 12. The spring mounting of spherical head 130 along with stem 132 permit continued pivotal movement of activation arm 122 after spherical head 130 contacts outlet valve seat 116. In addition, the lever arm effect of activation arm 122 significantly increases the load exerted by the buoyancy of float 18 thus insuring the sealing of air discharge valve 68. Once activation arm 122 reaches this position, magnet 140 and magnet 64 are mutually attracted causing a magnetic locking which holds activation arm 122 in the upward position. Magnets 140 and 64 are allowed to snap together due to the movement of bracket 146 with respect to actuating rod 76 as actuating rod 76 moves within slot 148.

When activation pin 126 lifts ball 98 off of inlet valve seat 96 and compressed air enters the interior of pump body 12, fluid within pump body 12 is forced up through outlet port 42, through dip tube 16, through discharge port 56 and through the associated discharge line. Fluid is not allowed to exit pump body 12 other than through outlet port 42 due to the operation of air discharge vane 68 and end cap check valve 22. Fluid continues to leave pump body 12 and eventually float 18 begins to lower. As float 18 begins to move downward, air inlet valve 66 is held open and air discharge valve 68 is held closed by the magnetic attraction of magnets 140 and 64 holding activation arm 122 in an upward position. As float 18 continues to lower, float 18 will contact lower stop 74 and thus begin to exert a load on the attached magnets 140 and 64 due to the weight of float 18 reacting through actuating rod 76. When the level of fluid within pump 12 lowers to the point that the weight of float 18 supported by actuating rod 76 exceeds the load necessary to separate magnets 140 and 64, activation arm 122 pivots downward and closes air inlet valve 66 and opens air discharge valve 68. Downward movement of float 18 is limited by lower step 78 on dip tube 16. Pumping system 10 will then begin another cycle. This pump cycling will continue as long as compressed air is provided to air inlet valve 66 and fluid is present in the well surrounding pumping system 10.

While the above detailed description describes the preferred embodiment of the present invention, it should be understood that the present invention is susceptible to modification, variation and alteration without deviating from the scope and fair meaning of the subjoined claims.

What is claimed is:

1. A pump for directing liquid out of a well, said pump comprising:

an outer tube forming an outer chamber therein;

an inner tube forming an obstruction free inner chamber therein, said inner tube disposed within said outer chamber of said outer tube;

first inlet means at a first end of said outer tube for permitting liquids to enter said outer chamber;

second inlet means at a first end of said inner tube for permitting liquids to enter said inner chamber;

a discharge housing at a second end of said inner and outer tubes, said discharge housing having a fluid discharge port in communication with said inner chamber of said inner tube;

a gas inlet valve disposed within said discharge housing for selectively admitting in a pump discharge mode and blocking in a pump refill mode a pressurized gas into said outer chamber;

a gas discharge valve disposed within said discharge housing for selectively venting in said pump refill mode and blocking in said pump discharge mode said gas within said outer chamber;

a float slidably disposed within said outer chamber, said float being buoyant in said liquid wherein said float slides from said first end to said second end of said outer tube in response to the level of said liquid in said outer chamber;

actuating means responsive to the position of said float for actuating said gas inlet valve and said gas discharge valve between said pump refill mode and said pump discharge mode, wherein said liquid is admitted into said outer chamber during said pump refill mode and said liquid is forced from said outer chamber through said obstruction free inner chamber during said pump discharge mode, said actuating means comprising:

an actuator rod disposed in said outer chamber, said actuator rod movable by said float;

an actuation arm disposed in said outer chamber, said actuation arm off-center pivotably secured at a first end thereof to said discharge housing and at a second end thereof to said actuator rod, said actuation arm movable by said float between an upward position and a downward position, said actuation arm operable to move said gas inlet valve and said gas discharge valve into said pump refill mode with a load significantly greater than the buoyancy load on said float when in said upward position and operable to move said gas inlet valve and said gas discharge valve into said pump discharge mode when in said downward position;

a first attracting magnet attached to said second end of said actuation arm;

a second attracting magnet disposed within said pump, said first and second attracting magnets operable to attract each other and hold said actuation arm in said upward position, said float operable to separate said first and second attracting magnets and move said actuation arm to said downward position.

2. The pump of claim 1 wherein said gas inlet valve comprises:

an internal surface defining an inlet passageway in communication with said outer chamber, said inlet passageway adapted to attach to a source of compressed gas at a first end and defining an inlet valve seat at a second end;

an inlet check ball disposed within said inlet passageway, said inlet check ball adapted to mate with said inlet valve seat to close said inlet passageway; and an actuation pin fixedly secured to said actuation arm, said actuation pin operable to unseat said inlet check ball from said inlet valve seat when said actuation arm is in said upward position.

3. The pump of claim 2 wherein said gas inlet valve comprises a housing fixedly secured within a gas inlet port.

4. The pump of claim 1 wherein said gas discharge valve comprises:

an internal surface defining a discharge passageway in communication with said outer chamber and with the outside atmosphere, said discharge passageway defining a discharge valve seat; and a stem secured to said actuation arm, said stem having a discharge check ball disposed thereon, said discharge check ball adapted to mate with said discharge valve seat, said stem operable to seat said discharge check ball within said discharge valve seat when said actuation arm is in said upward position.

5. The pump of claim 4 wherein said stem is slidably secured to said actuation arm and said discharge valve further comprises biasing means for biasing said discharge check ball away from said actuation arm.

6. The pump of claim 5 wherein said biasing means is a coil spring.

7. The pump of claim 4 wherein said gas discharge valve comprises a housing fixedly secured within a gas discharge port.

8. The pump of claim 1 wherein said actuation arm moves said gas discharge valve into said discharge mode prior to moving said gas inlet valve into said discharge mode.

9. The pump of claim 1 wherein said first inlet means comprises:

a housing fixedly secured to said first end of said outer tube, said housing defining an inlet passageway in communication with said outer chamber and an inlet valve seat; and an inlet check ball disposed within said outer chamber adjacent to said inlet valve seat, said inlet check ball adapted to mate with said inlet valve seat to close said inlet passageway and not allow said liquid to flow from said outer chamber.

10. The pump of claim 1 wherein said second inlet means comprises:

a housing fixedly secured to said first end of said outer tube, said housing defining a discharge passageway in communication with said outer chamber and said inner chamber, said discharge passageway defining a discharge valve seat; and a discharge check ball disposed within said discharge passageway, said discharge check ball adapted to mate with said discharge valve seat to close said discharge passageway and not allow said liquid to flow from said inner chamber to said outer chamber.

* * * * *